US005582290A

United States Patent [19]

McCuaig et al.

[11] Patent Number: 5,582,290

[45] Date of Patent: * Dec. 10, 1996

[54] DEVICE FOR SUPPORTING INVERTED GOLF CLUBS

[75] Inventors: Kenneth W. McCuaig, 55 Oak Dr., Orinda, Calif. 94563; George L. Brown, Benicia, Calif.

[73] Assignee: K. W. McCuaig, Orinda, Calif.

[ * ] Notice: The term of this patent shall not extend beyond the expiration date of Pat. No. 5,333,731.

[21] Appl. No.: 282,812

[22] Filed: Jul. 29, 1994

Related U.S. Application Data

[63] Continuation-in-part of Ser. No. 78,453, Jun. 15, 1993, Pat. No. 5,333,731.

[51] Int. Cl.[6] ..... A63B 5/00

[52] U.S. Cl. ..... 206/315.6; 206/315.3; 206/315.7

[58] Field of Search ..... 206/315.2–315.8; 211/70.2; 280/DIG. 6; 248/96

[56] References Cited

U.S. PATENT DOCUMENTS

| | | | |
|---|---|---|---|
| 646,889 | 4/1900 | Perkes | 280/DIG. 6 X |
| 1,189,879 | 7/1916 | Shamberg | 206/315.6 |
| 1,570,500 | 1/1926 | Kennedy | 206/315.3 |
| 2,047,079 | 7/1936 | MacMurray | 206/315.6 X |
| 2,070,254 | 2/1937 | Burgner | 206/315.6 |
| 2,502,627 | 4/1950 | Martin | 206/315.6 |
| 2,546,416 | 3/1951 | Alter et al. | 206/315.6 |
| 2,551,009 | 5/1951 | Kaltenbach | 280/51 |
| 2,559,552 | 7/1951 | Welshenbach | 206/315.2 |
| 2,699,951 | 1/1955 | Gans | 280/38 |
| 2,726,874 | 12/1955 | Sullivan | 280/37 |
| 2,799,315 | 7/1957 | Strasburg | 206/315.2 |
| 2,837,346 | 6/1958 | Chambless | 280/37 |
| 2,911,228 | 11/1959 | Green | 280/36 |
| 3,204,976 | 9/1965 | Srigley | 280/37 |
| 3,779,297 | 12/1973 | Stammer | 206/315.6 |
| 3,786,915 | 1/1974 | Potts et al. | 206/315.2 X |
| 4,200,131 | 4/1980 | Chitwood | 211/70.2 X |
| 4,836,565 | 6/1989 | Catalo | 280/37 |
| 4,858,761 | 8/1989 | Fumia | 206/315.3 |
| 4,863,019 | 9/1989 | Lewis et al. | 206/315.3 |
| 5,029,703 | 7/1991 | Dulyea, Sr. | 211/70.2 X |
| 5,060,796 | 10/1991 | Brooks, III | 206/315.6 |
| 5,069,481 | 12/1991 | Strange | 280/769 |
| 5,071,147 | 12/1991 | Stansbury | 280/47.19 |
| 5,168,992 | 12/1992 | Bowdy | 206/315.6 |
| 5,238,109 | 8/1993 | Smith | 206/315.3 X |
| 5,333,731 | 8/1994 | McCuaig | 206/315.3 X |

FOREIGN PATENT DOCUMENTS

| | | | |
|---|---|---|---|
| 719092 | 2/1932 | France | 206/315.3 |
| 214555 | 8/1967 | Sweden | 206/315.6 |
| 733631 | 7/1955 | United Kingdom | 280/DIG. 6 |
| 1295246 | 11/1972 | United Kingdom | 206/315.2 |

*Primary Examiner*—Sue A. Weaver
*Attorney, Agent, or Firm*—Terry McHugh

[57] ABSTRACT

A device for supporting a set of golf clubs includes a door having a vertical interior surface and an inclined surface that slopes downwardly and outwardly from the interior surface at the lower end of the door. Golf clubs are inserted into the device in an inverted condition, so that grip ends of the clubs contact the inclined surface. A second point of contact with the clubs is provided by a support structure that extends from the interior surface to contact shafts of the clubs near the club heads. A third point of contact is at a side of the golf clubs both opposite to and intermediate of the first two points of contact, thereby providing a triangular configuration of contact support. In the preferred embodiment, the third point of contact is provided by a member that projects inwardly beyond a panel which provides a support seat for the grip ends of the clubs.

16 Claims, 5 Drawing Sheets

DEVICE FOR SUPPORTING INVERTED GOLF CLUBS

CROSS REFERENCE TO RELATED APPLICATION

This is a continuation-in-part of application Ser. No. 08/078,453, filed Jun. 15, 1993, U.S. Pat. No. 5,333,731, issued Aug. 2, 1994.

TECHNICAL FIELD

The present invention relates generally to carrying devices for golf clubs and more particularly to devices for securing a set of golf clubs in an accessible manner.

BACKGROUND ART

Conventional golf bags function well for their intended purpose of storing the clubs during golf play. However, the shape of the bag and the manner in which the clubs protrude from the bag are less than optimal for purposes of storing and transporting the golf clubs. Moreover, the cylindrical sides are typically made of a flexible material, e.g., leather or vinyl, that does not provide the desired protection to golf clubs during airline, bus or truck travel. Bag covers prevent individual clubs from sliding from the bag during shipment or travel, but typically such covers do not protect golf clubs from damage caused by forcible impact, including axial forces that may be encountered during travel as the golf bag is handled and stored as baggage. Such axial compression will potentially damage the golf clubs, including the hosel area.

U.S. Pat. No. 5,071,147 to Stansbury describes a club-carrying device that provides an increased degree of protection. The device includes a rigid housing having a rectangular cross section and having a forwardly angled open top that is hinged at a rearward edge to a lid. Shafts of the clubs are protected by the housing, and closing the lid will completely cover the heads of the clubs. The device significantly increases protection of the golf clubs, but the device is large and difficult to carry.

In addition to protecting clubs, another consideration in the design of a golf bag is the presentation of clubs during golf play. U.S. Pat. Nos. 4,836,565 to Catalo and 5,168,992 to Bowdy describe golf club carriers in which at least some of the clubs are held with the club heads facing downwardly. Because it is difficult to distinguish individual clubs when the clubs are stored in a head-down position, the club presentation provided by these carriers is less than ideal.

Another aspect to proper club presentation is the accessibility of clubs when the club carrier is joined to a golf cart, such as a motorized golf cart. Carts are constructed to accommodate conventional golf bags. Any improvement to club transportation must take into account the space allocations on a golf cart and the means for attaching the club carrier to the golf cart.

An object of the present invention is to provide a device for supporting a set of golf clubs in a condition that provides protection against the rigors of airline, bus and trucking travel and shipment, while allowing easy access to the clubs during a golf match.

SUMMARY OF THE INVENTION

The above object has been met by a device which supports golf clubs in a closely packed, inverted condition that minimizes lateral movement, but permits easy withdrawal.

In the preferred embodiment, the device is a door of a hinged carrying case. Each club has a rest position having at least three points of contact with the device. However, upward movement of the club from the rest position releases the club from a lowermost point of contact with an inclined surface, thereby allowing the club to be pivoted from the device.

The door includes a major interior surface having an upper end and a lower end when the door is in an upright condition. At the lower end of the interior surface is the inclined surface that slopes downwardly with departure from the major interior surface. That is, the inclined surface is configured to gravity feed a golf club toward a bottom of the device. A grip end of the club is inserted into the device to contact the inclined surface. The grip end comes to rest at or near the bottom of the inclined surface. Support structure extends from the major interior surface to contact the shaft of the golf club proximate to the club head. Thus, a first point of contact is with the inclined surface and a second point of contact is with the support structure. Preferably, the support structure is made of a material which provides cushioning. A horizontally extending elastomeric member may be utilized in order to reduce the risk of scratching the shafts of the clubs.

The third point of contact is one designed to provide an opposed force. That is, structure is provided on the side of the golf clubs opposite to the inclined surface and the support structure. This third point of contact is between the other two points of contact, providing a triangular support at the end of the grip ends of the golf clubs. A panel extends upwardly to limit the extent to which the grip ends move away from the major interior surface. The third point of contact is preferably closer to the major interior surface than the panel. That is, the apex of the triangular support is inward of the plane defined by the panel. In one embodiment, the third point of contact is provided by a horizontally extending bar.

The triangular support prevents the golf clubs from moving forwardly or rearwardly. Lateral movement may be minimized by providing spacer members between adjacent clubs. For example, an inverted V-shaped spacer may extend from the major interior wall to the region between two golf clubs. Preferably, the extent of the spacers into the region between the two clubs is less than the radius of the clubs, so that the set of golf clubs can be closely packed.

An advantage of the invention is that the clubs are held in a rattle-free condition. Yet, the clubs are easily accessible, since a slight upward movement of a club frees the grip end from contact with the inclined surface to permit the club to be pivoted from the device. Another advantage is that the clubs are held in an inverted condition in which the various clubs can be distinguished from one another. As previously noted, the preferred embodiment includes the triangular support as part of a door. The door may be hinged to a substantially identical second door, dividing a set of clubs into two groups. However, the triangular support may also be used in other environments, such as club presentation within a sporting goods facility.

In an alternative embodiment, the support structure is deleted and the uppermost point of contact is contact of the golf club head with the major interior surface. However, employment of the support structure is preferred.

BEST MODE FOR CARRYING OUT THE INVENTION

Figure 1:
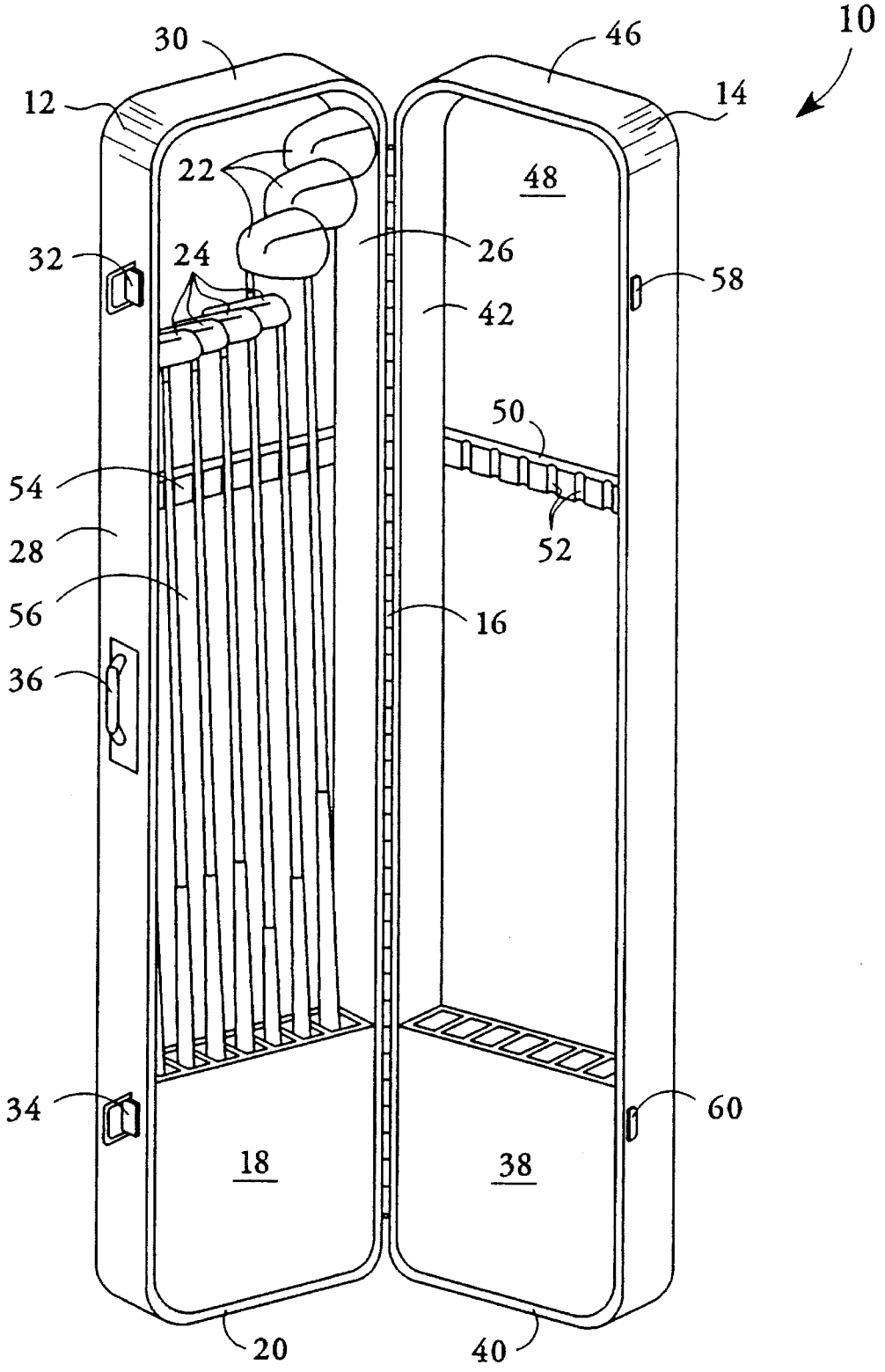
FIG. 1 is a perspective view of a golf case having a first portion of a set of golf clubs supported in an inverted condition in accordance with the present invention.

With reference to FIG. 1, a golf case 10 is shown as including a first door 12 and a second door 14 joined together at a hinge 16. The case is made of a rigid material that is able to withstand an impact of the type to be expected during shipment and travel. A suitable material is a hard-shell ABS plastic. The golf case is preferably lined with extruded aluminum valances to further strengthen the case.

The first door includes a segmented support 18 at a bottom wall 20. The segmented support 18 maintains seven golf clubs 22 and 24 in inverted side-by-side relationship. In the preferred embodiment, the segmented support independently maintains this relationship. That is, no other structure is required to secure the clubs 22 and 24 when the golf case 10 is in the upright position of FIG. 1.

In addition to the bottom wall 20, the first door 12 includes an inner wall 26, an outer wall 28 and a top wall 30. The outer wall includes a pair of latches 32 and 34, as well as a handle 36. While the handle is shown as being centered along the outer wall, typically the center of gravity will be closer to the top wall 30 when the clubs are inserted, so that the handle 36 should be adjusted accordingly.

The United States Golf Association rules limit a player to fourteen clubs during a round of golf. The case 10 may be used to carry seven clubs 22 and 24 in a single door 12, but preferably the second door 14 is also equipped to carry seven clubs. Similar to the first door, the second door 14 includes a segmented support 38 and bottom, inner, outer and top walls 40, 42, 44 and 46, respectively. The segmented support 38 is structured to independently maintain seven clubs in an inverted condition. A major inner surface 48 of the second door includes a raised region 50 to contact the shafts of the golf clubs. The raised region is shown as having detents 52 aligned to receive the club shafts. However, the detents are optional. The raised region may be a strip of foam that is adhere to the major inner surface 48 behind a cloth which lines the major inner surface. The first door 12 also includes a raised region 54 along a major inner surface 56.

The outer wall 44 of the second door 14 includes catches 58 and 60 aligned for coupling to the latches 32 and 34 on the outer wall 28 of the first door 12. At the inner walls 26 and 42 of the doors, the hinge 16 is attached to allow the doors to swing with respect to one another.

Figure 2:
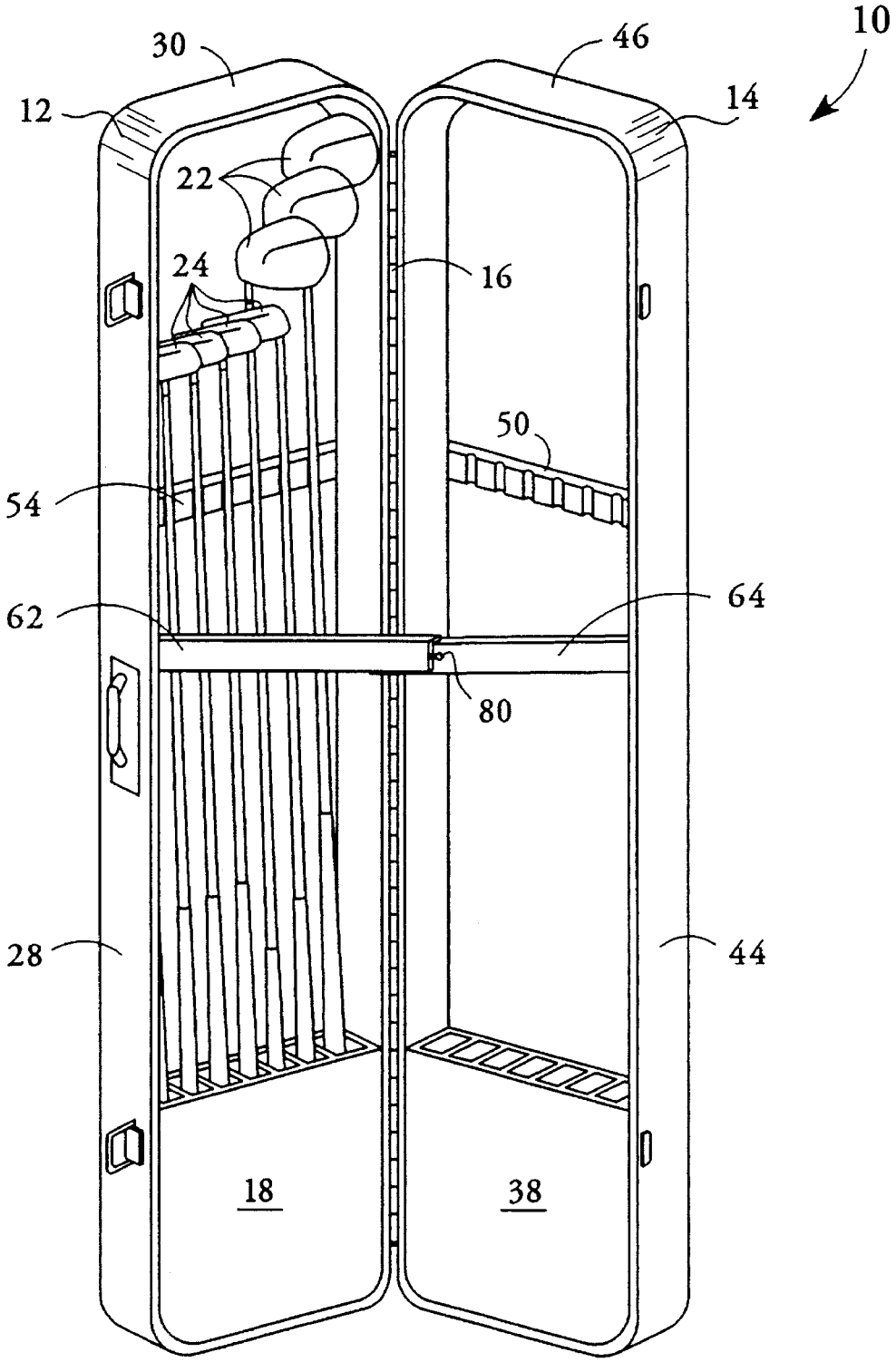
FIG. 2 is a perspective view of the golf case of FIG. 1 with first and second bar mechanisms securing hinged doors at a fixed angle.

Shown in FIG. 2 are first and second bar mechanisms 62 and 64 that selectively secure the doors 12 and 14 at a fixed angle to each other. Preferably, the first bar 62 is attached to the second bar 64 in a manner that permits adjustment of the selected angle. For example, the first bar mechanism 62 may have hook material, while the second bar mechanism includes loop material of the type sold under the trademark VELCRO by Velcro Inc. Alternatively, a pin arrangement may be used to relocate a pin of the first bar mechanism to any one of a series of holes, not shown, in the second bar mechanism. Other arrangements are available.

The bar mechanisms 62 and 64 are attached to form an angle that depends upon playing conditions. For example, if the golf case 10 is to be positioned within a motorized golf cart, the attachment of the bar mechanisms may depend upon the space allocated upon the golf cart for a club-carrying container. The bar mechanisms provide a means for varying the space required by the golf case. An important feature of the use of the bar mechanisms is that there is no interference with the insertion and removal of the golf clubs 22 and 24. This is in contrast to pivoting bracket devices extending between walls such as top walls 30 and 46. The pivoting bracket devices would add an obstacle for removal of longer clubs, such as the woods 22.

Figure 3:
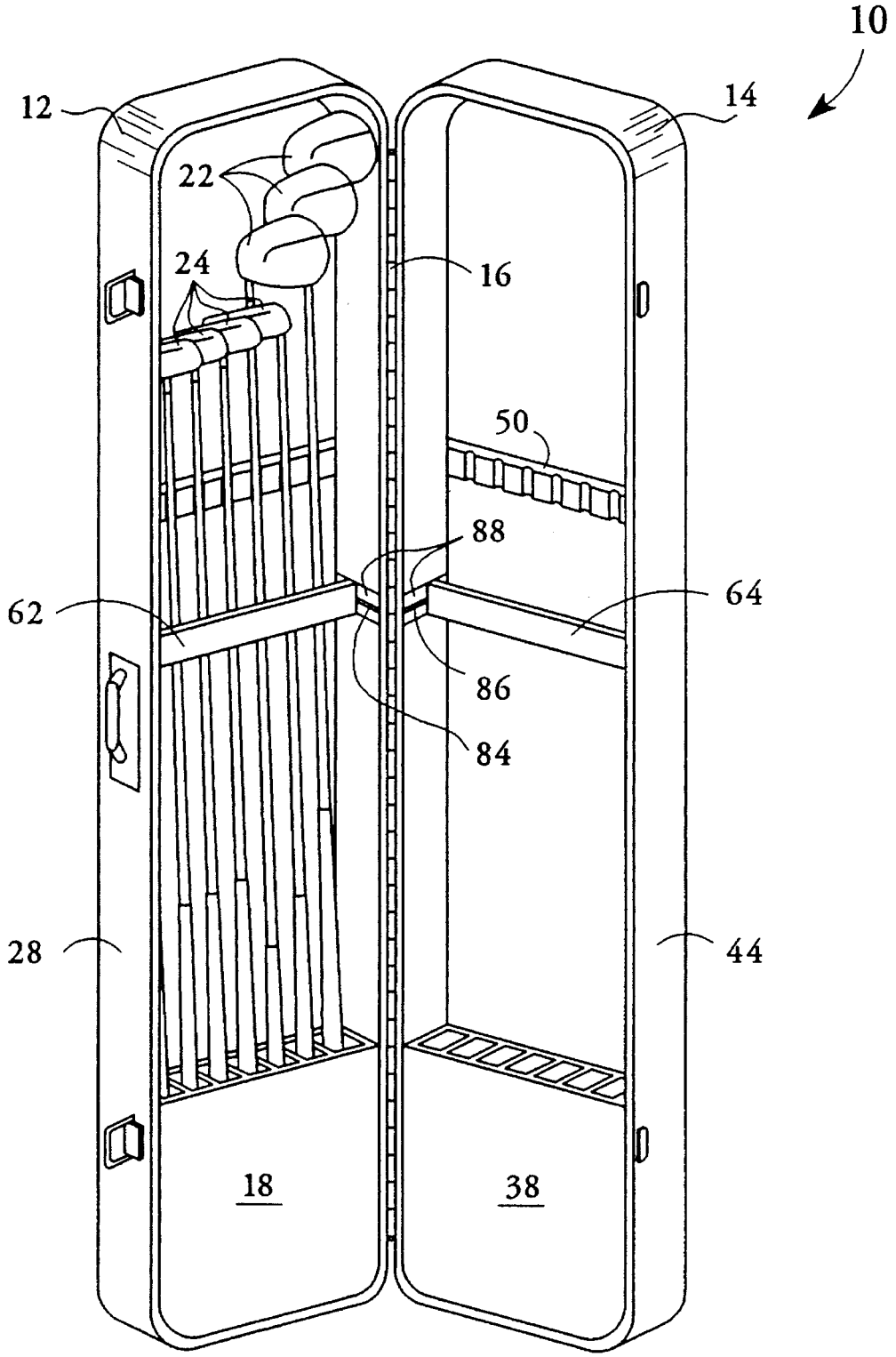
FIG. 3 is a perspective view of the golf case of FIG. 2, wherein the bar mechanisms are fixed in locked positions to immobilize the golf clubs.

FIG. 2 illustrates the bar mechanisms 62 and 64 in play positions. With the bar mechanisms in these positions, the clubs are accessible for removal and insertion. At the conclusion of a round of golf, a player detaches the first bar mechanism from the second bar mechanism and then attaches each bar mechanism in a lock position shown in FIG. 3. In this position, the first bar mechanism 62 provides a compressive force onto the shafts of the clubs 22 and 24. While not shown, preferably the heads of the clubs 22 and 24 are separated from one another before the bar mechanisms are pressed into place. The force exerted on the shafts is sufficient to laterally and vertically immobilize the clubs regardless of whether the club shafts are fully received within the segmented support 18.

The operation of the bar mechanisms 62 and 64 can be best seen by referring to FIGS. 2–5. In the play position, the hook and loop arrangement 66 and 68 of FIG. 5 secures the doors 12 and 14 in a fixed open condition. Preferably, the hook material 66 on the first bar mechanism 62 and/or the loop material 68 on the second bar mechanism 64 extends along the entire length, so as to allow a greater flexibility in the selection of the open angle.

Each of the bar mechanisms 62 and 64 includes a pivot ball 70 and 72 that comprise a portion of a ball-and-socket arrangement. The ball-and-socket arrangements allow the bar mechanisms 62 and 64 to be swiveled with respect to outer door walls 28 and 44 to which the bar mechanisms are attached. Thus, the bars can be freely swiveled from the play positions of FIG. 2 to the lock positions of FIG. 3.

The pivot ball 70 at the end of first bar mechanism 62 is received within an opening 76 in a bracket 74 that defines the socket of the ball-and-socket arrangement. The opening 76 allows a neck region 78 to pass therethrough, but prevents passage of the pivot ball itself. The bracket 74 is affixed to the inside of the outer wall 28. A similar bracket is attached to the inside of the second door 14 to define a socket for the pivot ball 72 of the second bar mechanism 64.

Figure 4:
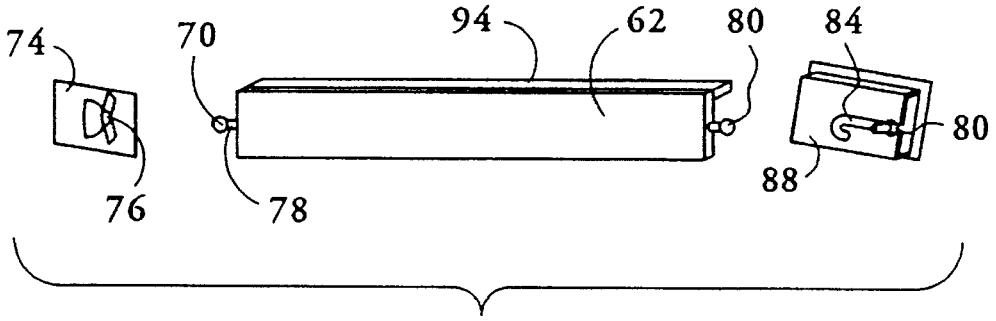
FIG. 4 is an exploded view of the arrangement of the bar mechanism and its retaining hardware.
Figure 5:
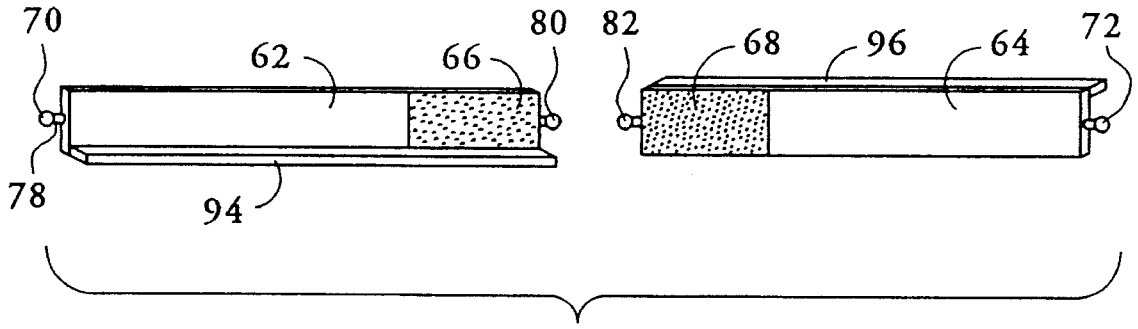
FIG. 5 is a perspective view of the two bar mechanisms of FIG. 3.

At the opposite ends of the bar mechanisms 62 and 64 are channel protrusions 80 and 82. The channel protrusions play no role when the bar mechanisms are in the play position shown in FIG. 2. However, the channel protrusions extend into bracket channels 84 and 86 when the bar mechanisms are in the lock positions shown in FIG. 3. The operation is best seen in FIG. 4. A channel protrusion 80 is received within a channel 84 of a bracket 88. The configuration of the channel is such that the protrusion is locked in position when the entire path of the channel has been traversed. Preferably, the configuration of the channel causes some rotation of the bar mechanism 62, thereby achieving a mechanical advantage to the compression of the bar mechanism against the shafts of the golf clubs 22 and 24.

Each of the first and second bar mechanisms 62 and 64 includes an elastomeric member 94 and 96. The elastomeric members are positioned to contact the shafts of the golf clubs 22 and 24 when the bar mechanisms are in the lock positions. In addition to reducing the risk of scratching the shafts, the elastomeric members provide a degree of deformation of the bar mechanisms in order to provide a force on the shafts from a range of angles. Thus, the lateral movement of the clubs is restricted by the deformation.

Figure 6:
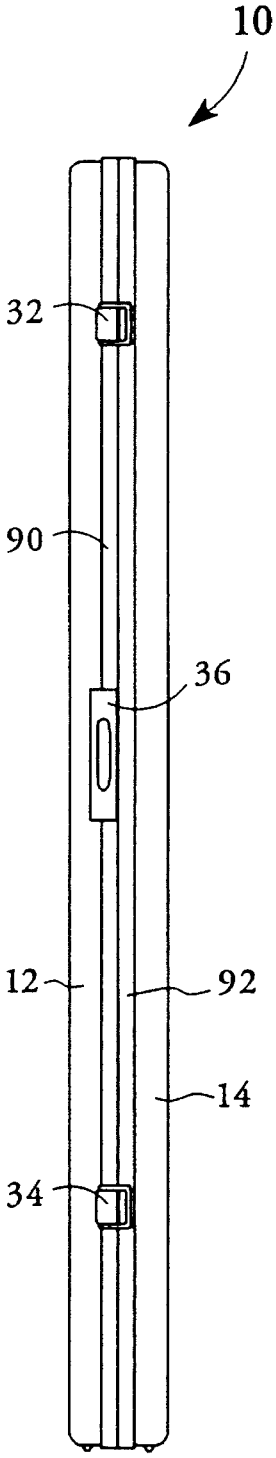
FIG. 6 is an end view of the golf case of FIG. 1.
Figure 7:
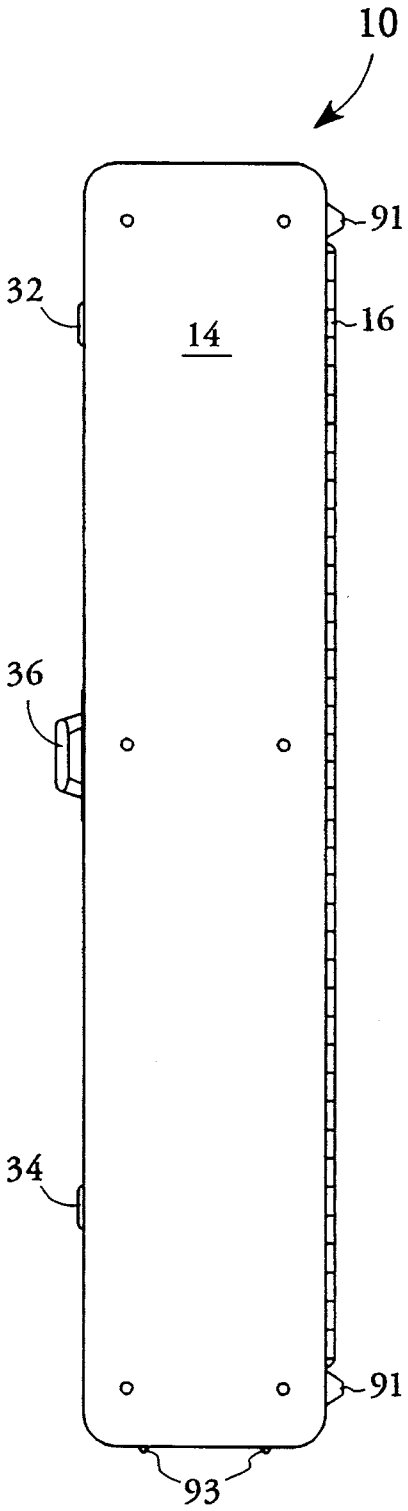
FIG. 7 is a side view of the golf case of FIG. 6.

Referring now to FIGS. 6 and 7, the golf case 10 is shown in a closed position. While not critical, the length of the golf case may be 47.5 inches, allowing the case to be stored in a typical overhead compartment of an aircraft. With respect to the front view of FIG. 6, a suitable side-to-side dimension is 4.0 inches. Aluminum valances 90 and 92 can be seen in FIG. 6. With regard to the side view of FIG. 7, a typical lateral dimension may be 10.1 inches. The case includes feet 91 and 93 on which the case will rest when it is placed on the case bottom or on the side of the case having the hinge 16.

In operation, when a player is ready to use the golf case 10, the case is opened to a desired angle and the first and second bar mechanisms 62 and 64 are interconnected in the manner shown in FIG. 2. The case is secured to a golf cart using standard cart straps. The clubs 22 and 24 are then available for play and are presented in a manner that facilitates club identification. The clubs are maintained in the side-by-side relationship by means of the segmented support 18.

Optionally, the golf clubs 22 and 24 are not fully supported by the support segment 18. For example, the bar mechanisms 62 and 64 may have a play position in which the bar mechanisms are moved slightly rearward of the lock position shown in FIG. 3, thereby releasing the clubs for play but simultaneously providing a surface against which the clubs lie. In this embodiment of a play position for the bar mechanisms, the clubs will rest at an angle relative to the golf case 10. The angle will depend upon the degree of movement of the bar mechanisms from a lock position to a play position. The channels 84 and 86 of the brackets 88 should be reconfigured to prevent escape of the associated bar mechanism. While this embodiment is possible, the above-described embodiment in which the bar mechanisms lock the first and second doors 12 and 14 at a fixed angle is preferred.

Figure 8:
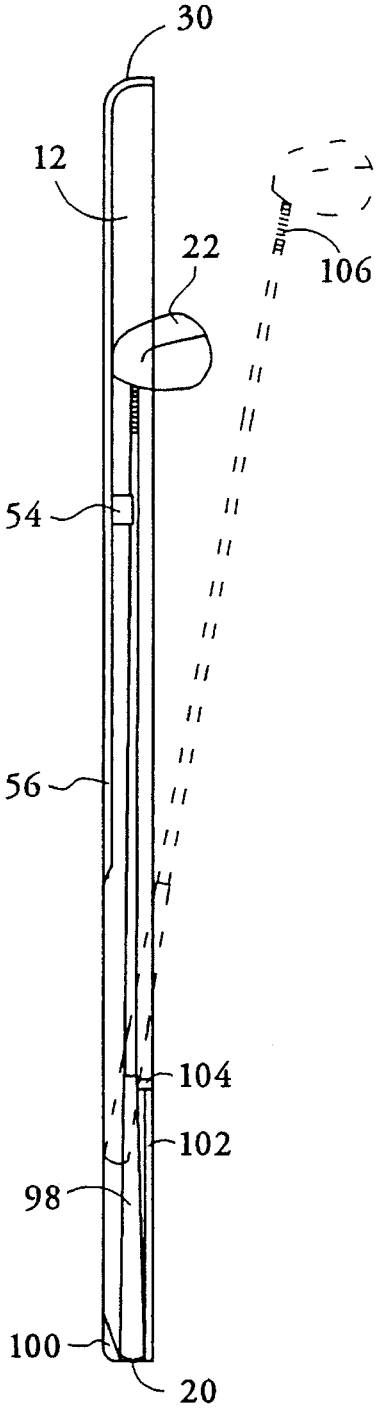
FIG. 8 is a side view of the operation of a second embodiment of a club support structure of one door of the golf case of FIG. 1.

A second embodiment of a support structure for a golf club 22 is shown in FIG. 8. A grip 98 of the club rests against the bottom wall 20 of the first door 12. A sloped surface 100 prevents rearward motion of the grip, while a vertical member 102 restricts the forward motion of the grip. Thus, the club remains in an upright position by a combination of gravitational force and the configuration of the walls.

If a club is longer than the one illustrated in FIG. 8, proper clearance of the top wall 30 becomes an important concern. The support must capture and organize golf clubs when not in use, but must also allow quick and easy access during removal, without bending of the clubs. These objectives are met by including a horizontal bar 104 extending parallel to the width of the first door 12. Ideally, the horizontal bar contacts the grip 98 or shaft of the golf club 22. Consequently, there will be points of contact with the club at the bottom wall 20, the horizontal bar 104, the raised region 54 and at the interface of the club head and the major inner surface 56. For purposes of illustration, only a top portion of the major inner surface is shown. As the club is moved upwardly, the club will slide along the points of contact with the horizontal bar 104, the raised region and the club head, but only a small degree of movement is necessary to free the grip 98 from contact with the sloped surface 100. The club 22 can then be pivoted forwardly, using the horizontal bar 104 as the pivot axis. Further upward movement increases the degree of pivot freedom. FIG. 8 illustrates a pivoted club 106 in phantom. Insertion of the golf club is accomplished by using the same pivoting action.

Figure 9:
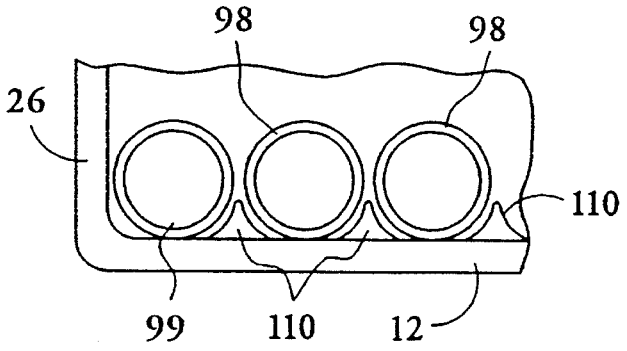
FIG. 9 is a top view of the golf support structure of FIG. 8.

In FIG. 9, the shafts 99 at the grip ends of the golf clubs are shown as being located between inverted V-shaped members 110. The configuration of the members permits easy acceptance of the grips 98. Although the V-shaped members are configured to prevent one golf grip from riding into the adjacent channel that is assigned to retain another golf grip, the dimensions of the V-shaped members allow the grips to contact one another. This contact allows a reduction of the widths of the case doors 12, as compared to the segmented support 18 shown in FIG. 1. The segmented support of FIG. 1 includes partitions that must be factored into the determination of the width of the case 10. By utilizing the embodiment of FIG. 9, the grips 98 can be held securely without the aid of partitions. Consequently, the width can be reduced to nine inches.

While not shown, a plate can extend perpendicularly from the wall 26 of FIG. 9 at a sufficient distance from the grips 98 and the inverted V-shaped members 110 to allow contact between adjacent club grips, while preventing one grip from entering the channel of another grip. Alternatively, the horizontal bar 104 of FIG. 8 may be used in place of the plate. Optionally, the horizontal bar 104 may be spring-loaded to provide a bias in the direction of the clubs. Because grips vary in diameter, shims may be added to the structure of FIG. 9 to ensure proper support of clubs having smaller grips 98.

Other segmented supports may be utilized. For example, brushes or other pliable structures may be added to each of the segments of the segmented supports 18 and 38 of FIG. 2 in order to apply a pressure to the club grips to accomplish the support while allowing easy removal and insertion. However, it has been discovered that the fixed support structure of FIGS. 8 and 9 is more reliable and reduces manufacturing complexities.

We claim:

1. A device for supporting a set of golf clubs in an inverted condition comprising:

a door having a major interior surface, said major interior surface having an upper end and a lower end;

seating means at said lower end for positioning a grip end of a golf club, said seating means having an inclined surface sloped downwardly and outwardly from said major interior surface;

support means extending from a region of said major interior surface intermediate of said upper and lower ends for contacting said golf club; and opposed means connected to said door for securing said golf club in contact with each of said inclined surface and said support means such that the longitudinal axis of said golf club is generally parallel to said major interior surface, said door having an upright condition in which said opposed means is at a level below said support means and above said seating means, said opposed means having a position relative to said seating means and said support means such that said golf club passes between said opposed means and said seating means.

2. The device of claim 1 wherein said door includes a bottom wall, said inclined surface of said seating means extending from said major interior surface to said bottom wall.

3. The device of claim 1 wherein said seating means includes an outer wall extending generally parallel to said major interior surface, said inclined surface being configured to gravitationally direct said golf club to contact said outer wall.

4. The device of claim 3 wherein said opposed means extends toward said major interior surface beyond a plane defined by said outer wall.

5. The device of claim 1 further comprising a plurality of spacers extending from said major interior surface, adjacent spacers being separated by a distance to receive a single golf club.

6. The device of claim 5 wherein said spacers extend from said major interior surface by a distance substantially less than a diameter of said grip end of said golf club.

7. The device of claim 1 further comprising a second door coupled to said door for holding a group of golf clubs.

8. The device of claim 7 wherein said door and said second door are coupled together by a hinge.

9. A device for holding a set of golf clubs in an inverted condition, wherein each golf club has a shaft, a grip end and a head end and wherein each grip end has a radius, said device comprising:

a substantially vertical wall having a rearward surface and a forward surface;

an inclined surface extending downwardly and forwardly from said forward surface of said vertical wall;

a bottom wall positioned at a lower extent of said inclined surface;

a forward wall extending upwardly from said bottom wall in spaced relation to said inclined surface to define a region of said bottom wall for receiving said grip ends of said golf clubs, said forward wall being spaced apart from said inclined surface by a distance sufficiently great to accommodate said grip ends between said forward wall and said inclined surface, said inclined surface directing said grip ends onto said region; and means cooperatively joined to said forward wall and extending rearwardly relative to said forward wall for contacting said golf clubs intermediate of said grip end and said head end to press said grip ends into contact with said inclined surface and to urge said head ends to contact said vertical wall.

10. The device of claim 9 further comprising structure extending from said vertical wall to contact said shafts of said golf clubs near said head ends, said inclined surface and said structure being cooperative with said means for contacting said golf clubs to maintain said golf clubs in substantially vertical positions.

11. The device of claim 10 wherein said structure is a pliable member attached to said vertical wall.

12. The device of claim 9 further comprising spacers extending from said vertical wall by a distance less than said radius of said grip ends, wherein adjacent spacers are arranged to maintain a single golf club therebetween, while allowing adjacent golf clubs to make contact.

13. The device of claim 9 wherein said vertical wall is a portion of a first door coupled to a second door by a hinge.

14. A device for transporting golf clubs comprising:

a first door having an upright position in which a major wall has an upper end and a lower end;

a panel connected to said first door in parallel spaced relation to a first side of said major wall;

an inclined surface connected to said first door within a space between said panel and said major wall, said inclined surface having an upper extent connected to said major wall and having a downward slope in the direction of said panel;

a contact bar connected to said door at a level above said inclined surface, said contact bar being spaced apart from said major wall and having a distance from said major wall that is less than a distance between said major wall and said panel; and support means extending from said first side of said major wall at a level above said contact bar for contacting shafts of inverted golf clubs at regions proximate to heads of said golf clubs.

15. The device of claim 14 further comprising a second door coupled to said first door by a hinge, said second door being generally identical to said first door.

16. The device of claim 14 wherein said contact bar is at an upper extent of said panel.

* * * * *